United States Patent [19]

Gerber

[11] 4,446,983

[45] May 8, 1984

[54] RESERVOIR COVER HAVING A DEFINED PERIPHERAL SUMP

[75] Inventor: Dennis H. Gerber, Los Gatos, Calif.

[73] Assignee: Burke Industries, Inc., San Jose, Calif.

[21] Appl. No.: 337,677

[22] Filed: Jan. 7, 1982

[51] Int. Cl.[3] ..... B65D 88/38

[52] U.S. Cl. ..... 220/219; 220/216

[58] Field of Search ..... 220/216–227; 210/DIG. 9; 52/3

[56] References Cited

U.S. PATENT DOCUMENTS

| | | | |
|---|---|---|---|
| Re. 30,146 | 11/1979 | Dial et al. . | |
| 3,517,513 | 6/1970 | Renshaw et al. | 220/218 |
| 3,592,009 | 7/1971 | Alkmaar et al. | 220/219 |
| 3,815,367 | 6/1974 | Collins et al. | 220/216 |
| 3,874,175 | 4/1975 | Winters | 220/216 |
| 3,991,900 | 11/1976 | Burke et al. . | |
| 4,139,117 | 2/1979 | Dial | 220/221 |

*Primary Examiner*—Allan N. Shoap
*Assistant Examiner*—Robert Petrik
*Attorney, Agent, or Firm*—James R. Cypher

[57] ABSTRACT

A flexible impermeable cover for a reservoir which completely covers the fluid in the reservoir and facilitates the removal of surface rainwater to a defined peripheral sump immediately adjacent and completely surrounding a central floating cover portion. Float means are attached to at least substantially the entire border area of the central portion and weight means are affixed to the cover outwardly of the central portion and adjacent the float means in substantially all of the border area so as to tension all of the central portion. The weight means also create a defined peripheral sump outwardly and immediately adjacent the entire border area of the central portion which collects the surface rainwater from the central portion.

10 Claims, 15 Drawing Figures

RESERVOIR COVER HAVING A DEFINED PERIPHERAL SUMP

BACKGROUND OF THE INVENTION

This invention relates to surface covers for reservoirs of liquid in which the cover material is a flexible impermeable synthetic rubber such as Hypalon; a registered trademark of the Dupont Company.

There are but two primary patents in this field. The first was granted to Dial, U.S. Re Pat. No: 30,146, Nov. 13, 1979, and the second was granted to Burke, et al, U.S. Pat. No. 3,991,900, Nov. 16, 1976.

Dial, discloses a method of removing rain water from reservoir covers by raising a central portion of the cover by the use of floats and collecting the water in an undefined, non-tensioned peripheral depending collection sump. Since, it is too expensive to place floats beneath the entire central portion, the floats are arranged in rows and in theory the rain water flows toward the peripheral sumps along channels between the rows of floats. In practice, however, the rainwater collects in random puddles throughout the central portion where it frequently collects in large quantities causing stress in the material leading to early failure of the cover or in cold climates, freezing and subjecting the cover to cutting as well as excess weights stress the central floating portion is untensioned.

Further, the collection sump is formed at an undefined site anywhere between the central floating area and the edge of the reservoir.

Burke, taught a reservoir cover structure for creating positionally defined sumps. The first primary method of creating the sump was to attach weights to the cover along intersecting lines. The second primary method was to attach lines of floats along intersecting lines. Burke, supra did not teach a cover having a defined peripheral sump formed by the combination of weights and floats.

SUMMARY OF THE INVENTION

This application teaches the attachment of weights to the periphery of a floating central portion so that the central portion is placed in tension and a well defined peripheral collection sump is formed outwardly and immediately adjacent the floating central portion at all operating water levels.

An object of the present invention is to eliminate the formation of puddles of rainwater in the central floating portion of reservoir covers and to drain all such water to a defined and tensioned peripheral collection sump immediately adjacent the floating central portion.

A further object is to achieve the above objectives at a minimal additional cost.

DESCRIPTION OF THE PREFERRED EMBODIMENTS

The reservoir cover 1 of the present invention consists briefly of a flexible impermeable material which is attached to the periphery of the reservoir by any of several standard techniques. The cover is one single sheet made up of many smaller strips joined together and dimensioned to completely cover and lie in surface contact with the vertical walls V or slope sided walls S and bottom B of the reservoir when it is empty.

Figure 1:
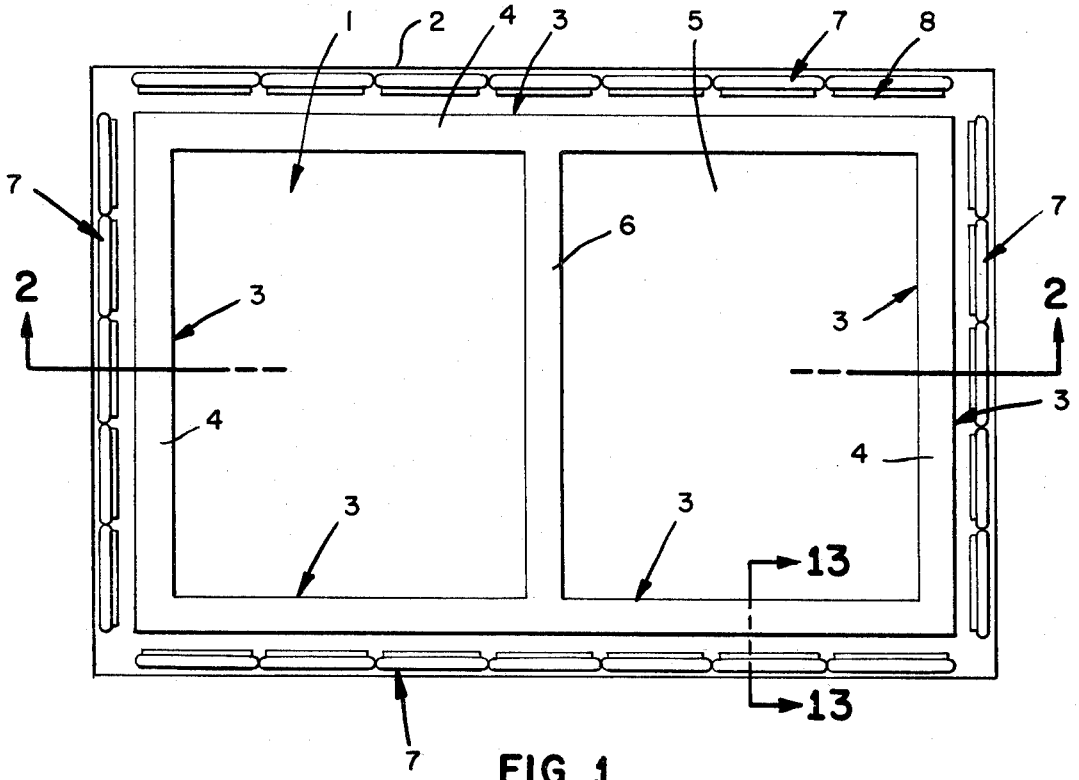
FIG. 1 is a plan view of a reservoir illustrating one form of the present invention.
Figure 2:
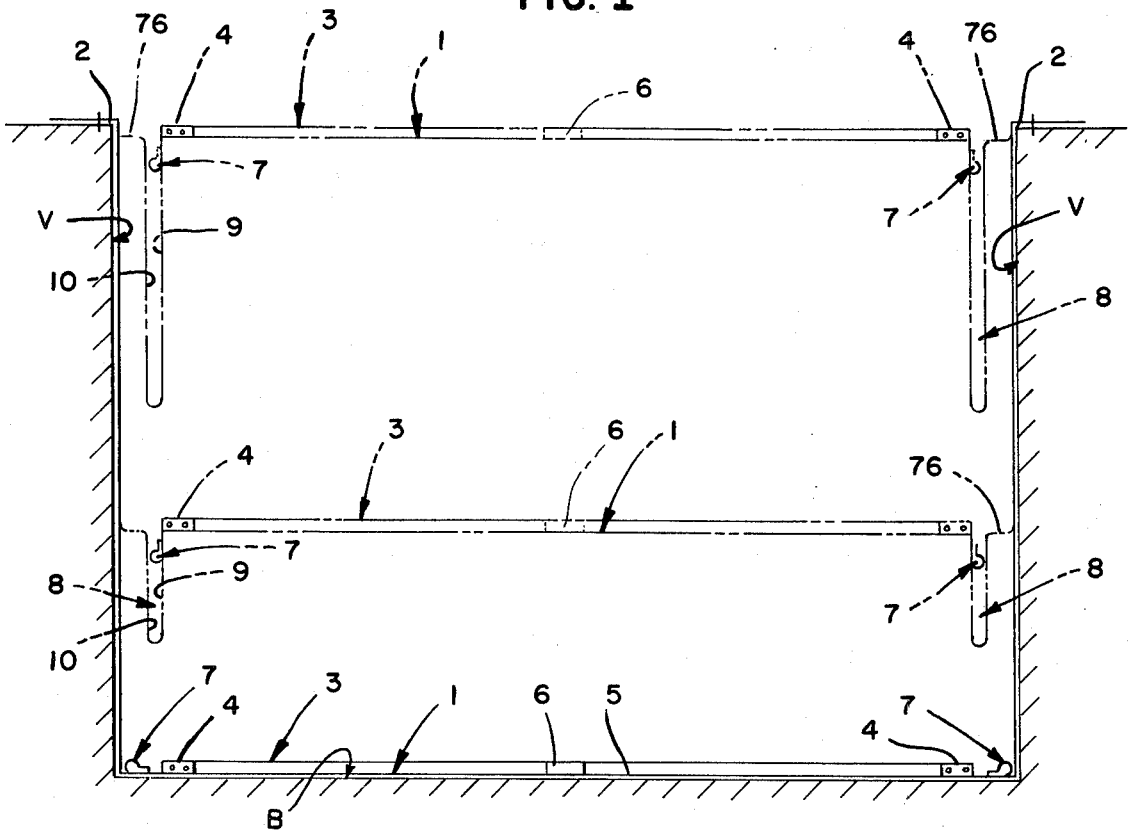
FIG. 2 is a cross section taken along line 2—2 of FIG. 1. The phantom lines show the position of the cover at two different water levels.

The first embodiment of the invention is illustrated in FIGS. 1 and 2. Float means 3 are attached to and buoyantly carry at least the entire border area 4 of a central portion 5 of the cover. One or more transverse floats 6 may be used to stabilize the central area. Weight means 7 are affixed to the cover outwardly of and substantially entirely surrounding the central portion and are positioned adjacent the float means in the border area so as to tension the entire central portion in both horizontal directions at all working levels of the reservoir. The weight means and the float means are positioned so as to form a defined peripheral sump 8 immediately adjacent and around the entire border area of the central portion. The sump has an inner sidewall 9 and an outer sidewall 10 in which the inner sidewall is in tension. In FIG. 2, the outer sidewall is not tensioned by weight 7. The weight means preferably is connected to the portion of the cover which lies in surface contact with the bottom of the reservoir when it is empty. The weight means are interrupted at the corners as explained later in connection with FIG. 12.

The weight means may be constructed from the same material as the cover in a tubular elongated form and filled with any material heavier than the fluid in the reservoir such as sand. The construction of tubular weights are discussed in my co-pending application entitled TENSIONED PLATE RESERVOIR COVER, Filed: Dec. 21, 1981. The weight means may be continuously attached to the cover or strapped at intervals. The weight means should be attached at a convenient distance from the end of the float means so that workmen can conveniently attach the weight at the reservoir site.

The float material may be any standard buoyant means used by the industry in constructing reservoir covers such as in Dial or Burke supra. The floats may be attached to the top or underside of the cover.

Operation of the cover is illustrated in FIG. 2. As water or other fluid is pumped into the reservoir beneath the cover, the float means cause the cover to lift at the perimeter of the central area. The weight means prevents the cover from lifting initially from the bottom outwardly of the floats. As the reservoir continues to fill, the weights are lifted from the bottom of the reservoir and the sump 8 is immediately formed. The phantom lines show the position of the cover, floats weight and sump when the reservoir is partially full. Note that the weight does not place any tension on the outer sidewall of the sump or the peripheral portion of the cover.

As the reservoir fills and reaches its maximum fill level, the upper phantom lines indicate the position of the cover, floats, weight means and sump. The sump is at its maximum depth and only the inner sidewall is tensioned by the weight means. The outer sidewall and peripheral portion 76 of the cover are not tensioned by the weight means.

During the filling of the reservoir, the central portion of the cover is placed in tension in both horizontal directions. Thus, rainwater which falls upon the cover immediately seeks the lowest point of the cover which is the periphery of the central area. When the rainwater reaches the peripheral floats it is desirable to drain the water into the peripheral sump. This may be accomplished by providing breaks in the floats at convenient intervals or a pipe beneath the floats.

Figure 13:
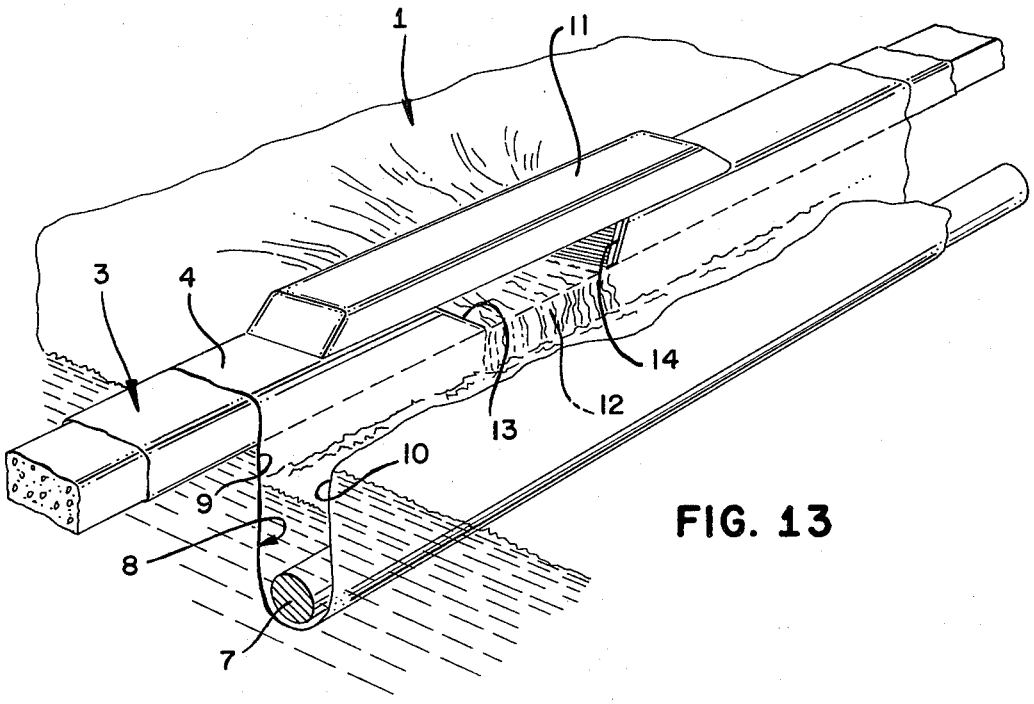
FIG. 13 is a perspective view on an enlarged scale of a typical type of drain for permitting flow of rain water from the central portion to a sump and taken in the area indicated by lines 13—13 on FIG. 1.

FIG. 13 illustrates a break in float means 3. A bridge member 11 is connected above the float means to stabilize the float means. Rain water as illustrated by the number 12 flows between ends 13 and 14 of the float means.

Figure 14:
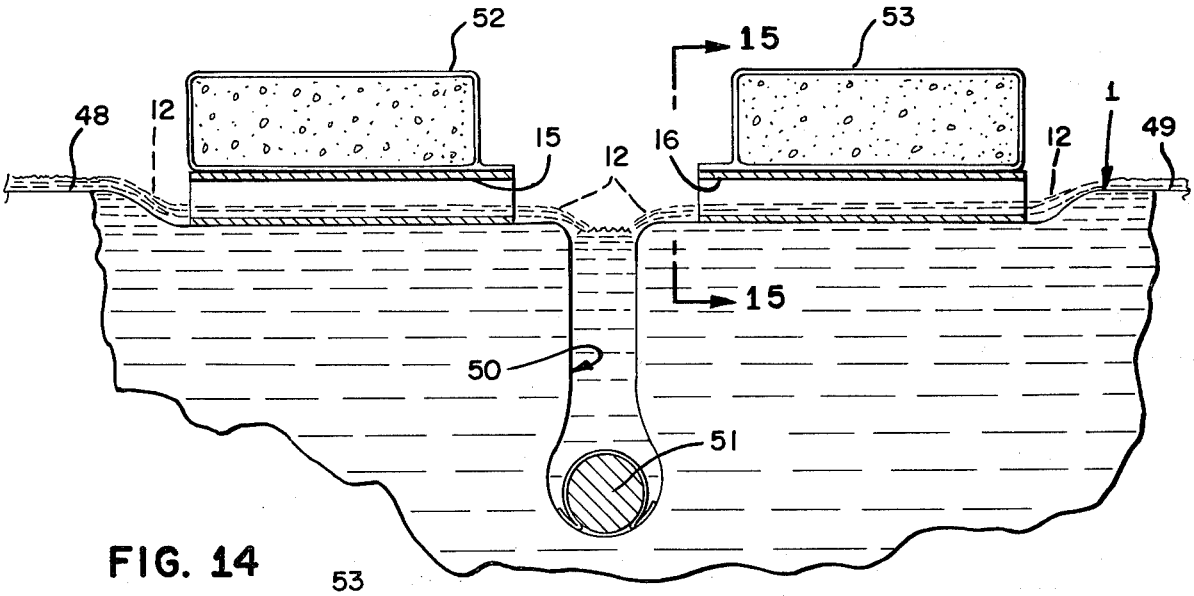
FIG. 14 is a cross sectional view on an enlarged scale of another type of drain taken along lines 14—14 of FIG. 9.
Figure 15:
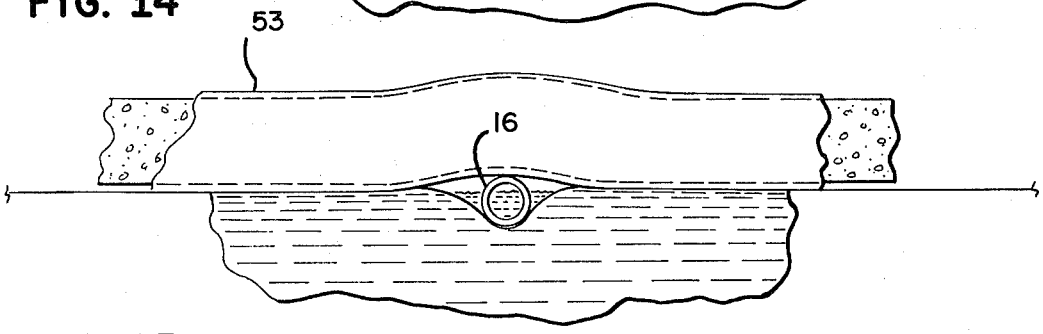
FIG. 15 is a cross sectional view taken along line 15—15 of FIG. 14.

FIGS. 14 and 15 illustrate the use of pipes 15 and 16 which are inserted beneath the float means. Rainwater 12 flows through the pipes and into the sump 50.

Figure 3:
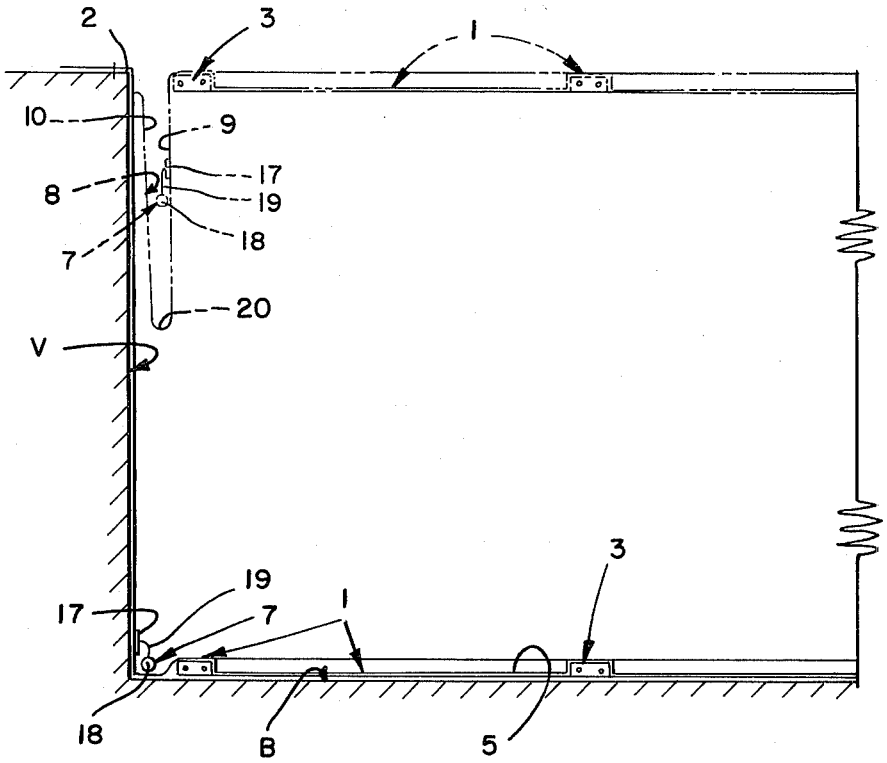
FIG. 3 is a cross section of an alternate form of the invention in a reservoir similar to the reservoir shown in FIG. 1 and showing the alternate cover taken along a line locationally similar to section lines 2—2. The phantom lines show the alternate form of the invention at a different water level.

FIG. 3 illustrates another form of the invention in which the weight means is formed with an attachment member 17 which is attached to the portion of the cover which lies in surface contact with the vertical wall V, a weighted tubular portion 18 positioned on the bottom portion of the cover when the reservoir is empty, and a web member 19 connecting the tubular weighted portion to the attachment member.

Figure 12:
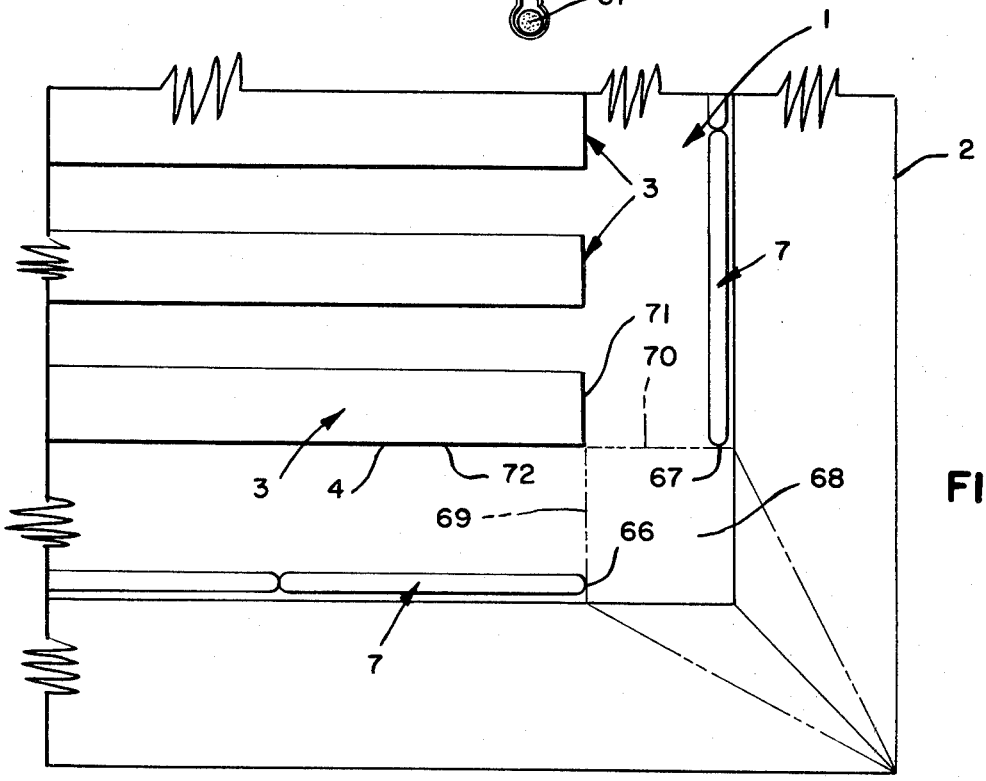
FIG. 12 is a fragmentary plan view on an enlarged scale taken generally within the lines 12—12 of FIG. 10.

It is to be understood that weight means 17 surrounds substantially the entire central section except for the corners as explained in FIG. 12.

Operation of the reservoir in FIG. 3 is as follows. As water or other fluid is pumped into the reservoir below the cover, the central portion 5 of the cover immediately floats above the bottom B while weight means 7 retains the peripheral portion of the cover on the bottom. As the water level rises, a peripheral sump is formed. The weight member 18 remains in the bottom of the sump until the web 19 flips over as the water level rises. At a predetermined point which depends on the initial length of the web, the attachment portion rises and lifts weight member 18 above the bottom 20 of the sump. The inner wall 9 is in tension at and above the attachment point 17 of the weight 18 under all working levels of the reservoir and the outer wall 8 is not tensioned by the weight member 18 after it lifts from the bottom 20 of the sump.

Figure 4:
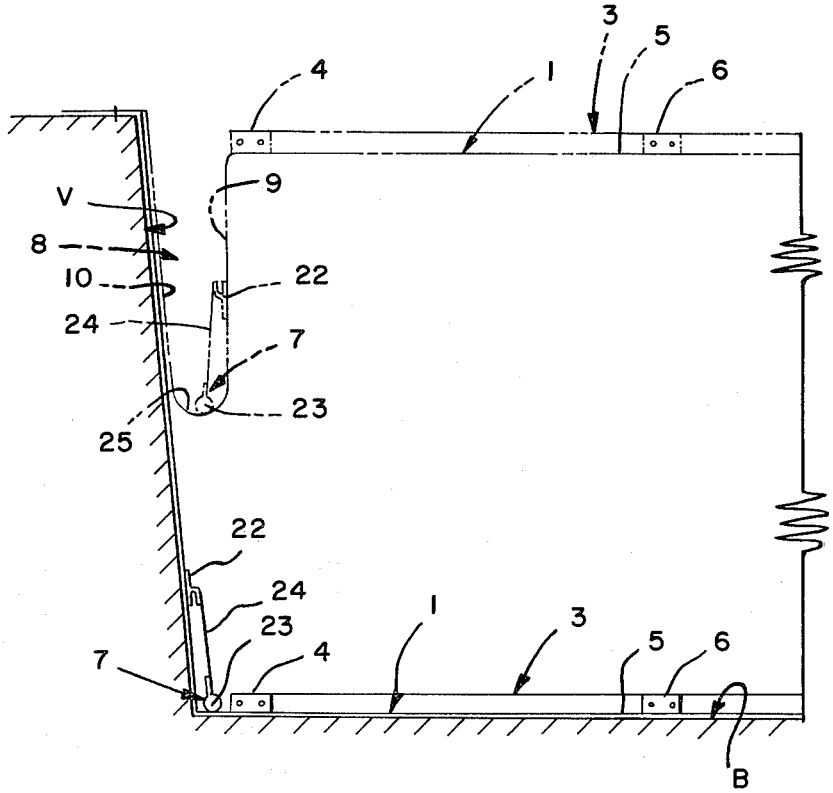
FIG. 4 shows still another modified form of the invention in a reservoir similar to that shown in FIG. 1 and taken along a line locationally similar to section line 2—2. Phantom lines indicate position of the cover at the full level.

FIG. 4 illustrates still another form of the invention. A substantially vertical sided reservoir is illustrated in which the weight means 7 is formed with an attachment member 22 which is attached to the portion of the cover which lies in surface contact with the vertical wall at a distance of at least one fourth ($\frac{1}{4}$) the reservoir full level from the bottom. A weighted tubular portion 23 is filled with sand or other material which has a specific gravity greater than the liquid in the reservoir. A web member 24 connects the tubular weighted portion to the attachment member and has a length dimensioned so that the weighted member rests on the bottom or close thereto. The weight means 7 surrounds substantially the entire central area except for the corners as explained later in connection with FIG. 12.

In operation, as water is pumped beneath the cover, the central buoyant portion 5 rises and rests upon the surface of the water or other fluid. Weight member 23 remains on the bottom of the reservoir until lifted by the floating central portion. As the water level rises, the attachment member 22 rotates from the outer wall 10 of the sump to the inner wall 9. Where the attachment member is attached to the cover at the one fourth ($\frac{1}{4}$) full level, the weight 23 will always remain in the bottom 25 of the sump. Where the weight remains in the bottom of the sump, the inner as well as the outer walls 9 and 8 of the sump will be tensioned by the weight at all working fluid levels of the reservoir.

Figure 5:
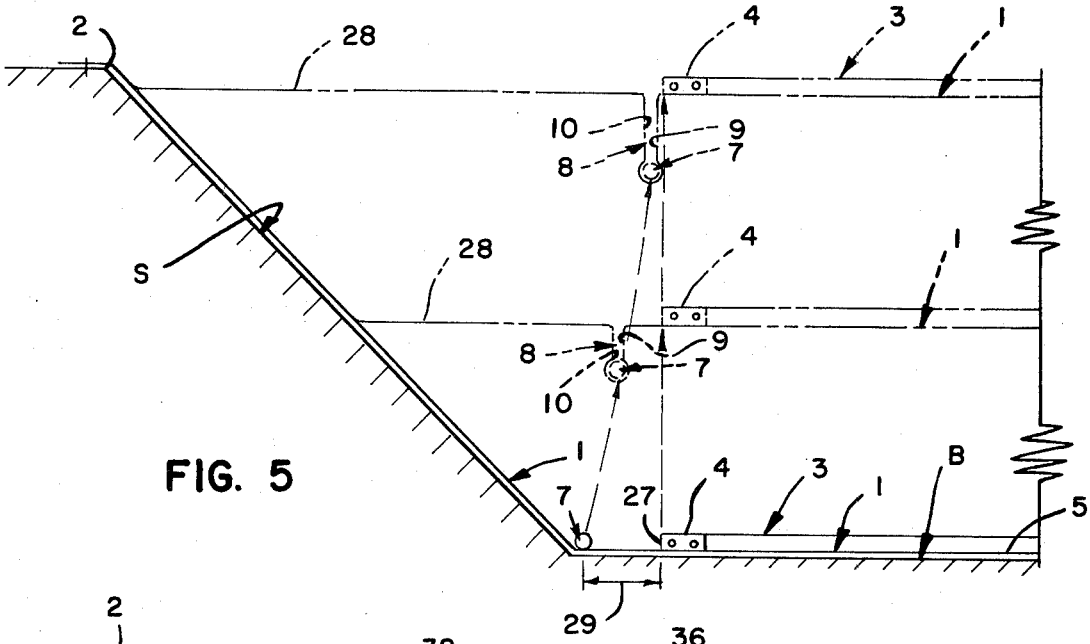
FIG. 5 is a cross sectional view of a slope sided reservoir using the same system of weights as illustrated in FIG. 2. The phantom lines show the position of the cover at different water levels.
Figure 6:
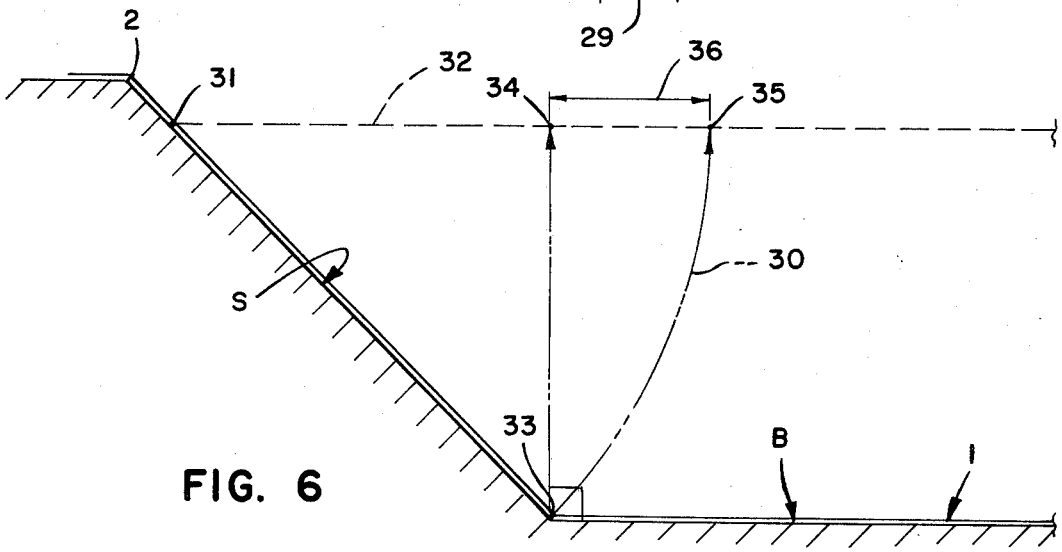
FIG. 6 is a schematic view of the reservoir shown in FIG. 5.

FIGS. 5 and 6 illustrates the use of the present invention in reservoirs having sloped sides S and a bottom B. The weight means 7 is connected to the portion of the cover which lies in surface contact with the bottom of the reservoir when it is empty.

The placement of the weight from the edge 27 of the peripheral float determines whether the peripheral portion 28 of the cover is tensioned by the weight. This critical distance is indicated by the line with the double arrows indicated by the number 29 in FIG. 5. This distance setting is better understood by reference to the diagramatic sketch in FIG. 6. An arc 30 is struck which has a length equal to the length of the slope wall S from point 31 which is on the full level 32 of the reservoir to the toe of the slope 33.

A vertical line is then projected from the toe of the slope 33 to the surface 32 to a point 34. Arc 30 is rotated and its intersection with the surface level 32 creates intersection point 35. The distance between points 34 and 35 and indicated by the double arrow 36 is known as the "slope allowance". Now, if the distance between the end of the float and the weight as indicated by the double arrow 29 is equal to or greater than one-half ($\frac{1}{2}$) of the "slope allowance", then the central portion 5 of the cover, the outer sidewall of the sump 10 and the peripheral portion of the cover 28 will all be in tension at all working levels of the reservoir. On the other hand, if the distance 29 is less than ½ the "slope allowance", then only the central portion of the cover and the inner side wall 9 of the sump will be in tension. As before, the weight means 7 surrounds substantially the entire center section except for the corners as explained in connection with FIG. 12.

Figure 7:
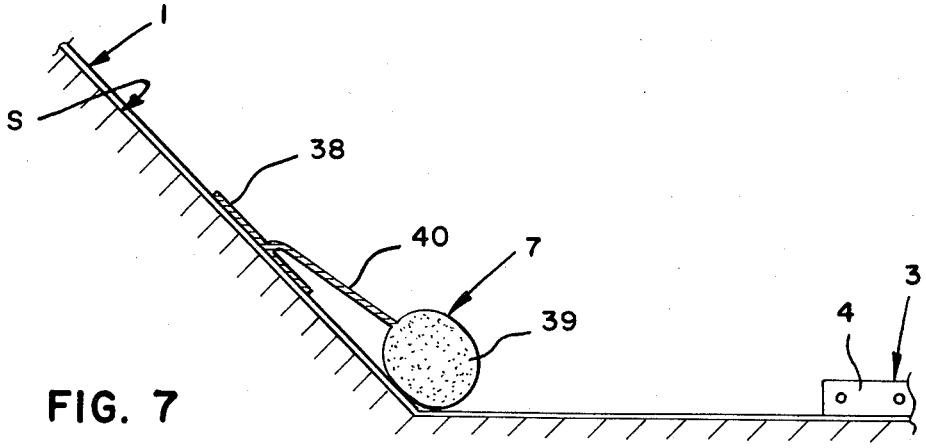
FIG. 7 is an enlarged cross sectional view of the same type of weights shown in FIG. 3.

FIG. 7 illustrates another form of the invention in connection with a slope sided reservoir. Here, the weight means is formed with an attachment member 38 which is attached to the portion of the cover which lies in surface contact with the slope side wall S. A weighted tubular portion 39 is positioned on the bottom portion of the cover when the reservoir is empty. A web member 40 connects the tubular weighted portion to the attachment member.

In operation, as fluid is introduced beneath the cover, the central portion of the cover rises with the level of the fluid. The periphery of the cover is held on the bottom by weight 39 until the floating central portion lifts the weight off the bottom. The operation of the weight is much like the operation described in FIG. 3. As the central portion continues to rise, the weight hangs from the inner wall of the sump which is formed and tensions the central portion and the portion of the inner sump wall above the point of attachment.

Figure 8:
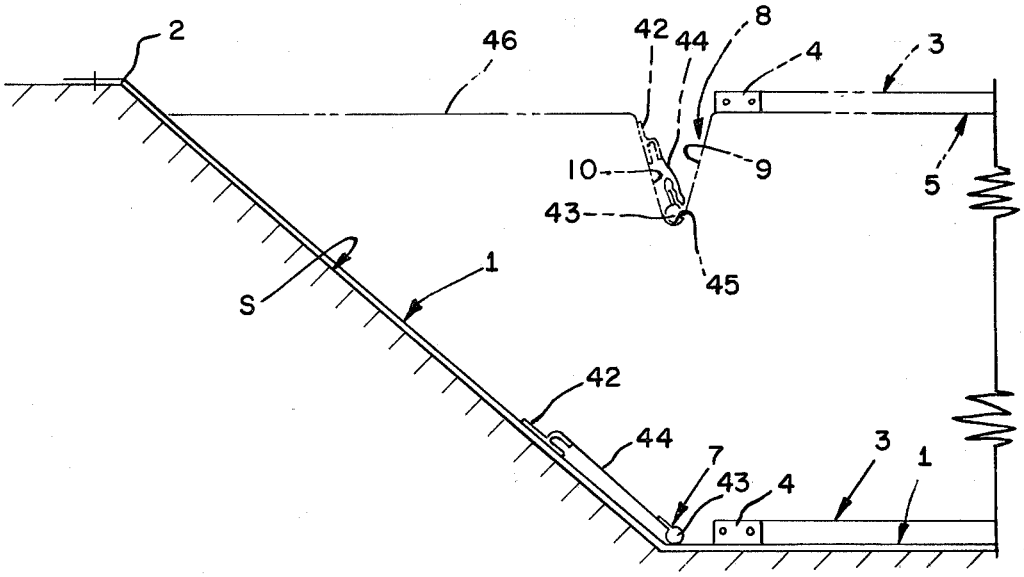
FIG. 8 is a cross sectional view of a slope sided reservoir having the same type of weights as illustrated in FIG. 4. The phantom lines show the position of the weight and cover when the reservoir is full.

FIG. 8 illustrates still another form of the invention in connection with a slope sided reservoir. In this form of the invention, the weight is attached outwardly from the floating central portion and in the peripheral portion of the cover at a specific location on the sidewall so that the peripheral portion of the cover is in tension under all working fluid levels of the reservoir.

To accomplish this objective, the weight means 7 is formed with an attachment member 42 which is connected to the portion of the cover which lies in surface contact with the slope sided wall S at a distance of at least one fourth (¼) the reservoir full level from the bottom. The weighted tubular member 43 is positioned on the bottom portion of the cover when the reservoir is empty. A web member 44 connects the tubular weighted portion to the attachment member.

In operation, as fluid is introduced beneath the cover, the central float portion 5 rises while the portion of the cover beneath weight 43 remains on the bottom. Thus, any rain water which begins to fall on the cover will be immediately drained off the central portion almost immediately after the filling operation begins. As the float means continue to rise, all of the cover is lifted off the bottom of the reservoir and a peripheral sump 8 is formed. In this form of the invention both the inner wall 9 and outer wall 10 of the sump are tensioned at all fill levels because the weight 43 always remains in the bottom portion 45 of the sump. As shown in the phantom lines, when the reservoir reaches maximum fill level the weight 43 is still in the bottom portion 45 of the sump, peripheral portion 46 of the cover is tensioned by the weight means. Note that the web member 44 in this example is actually slack. It is of course good design practice to dimension the length of the web 44 so that the least amount of slack will occur.

Figure 9:
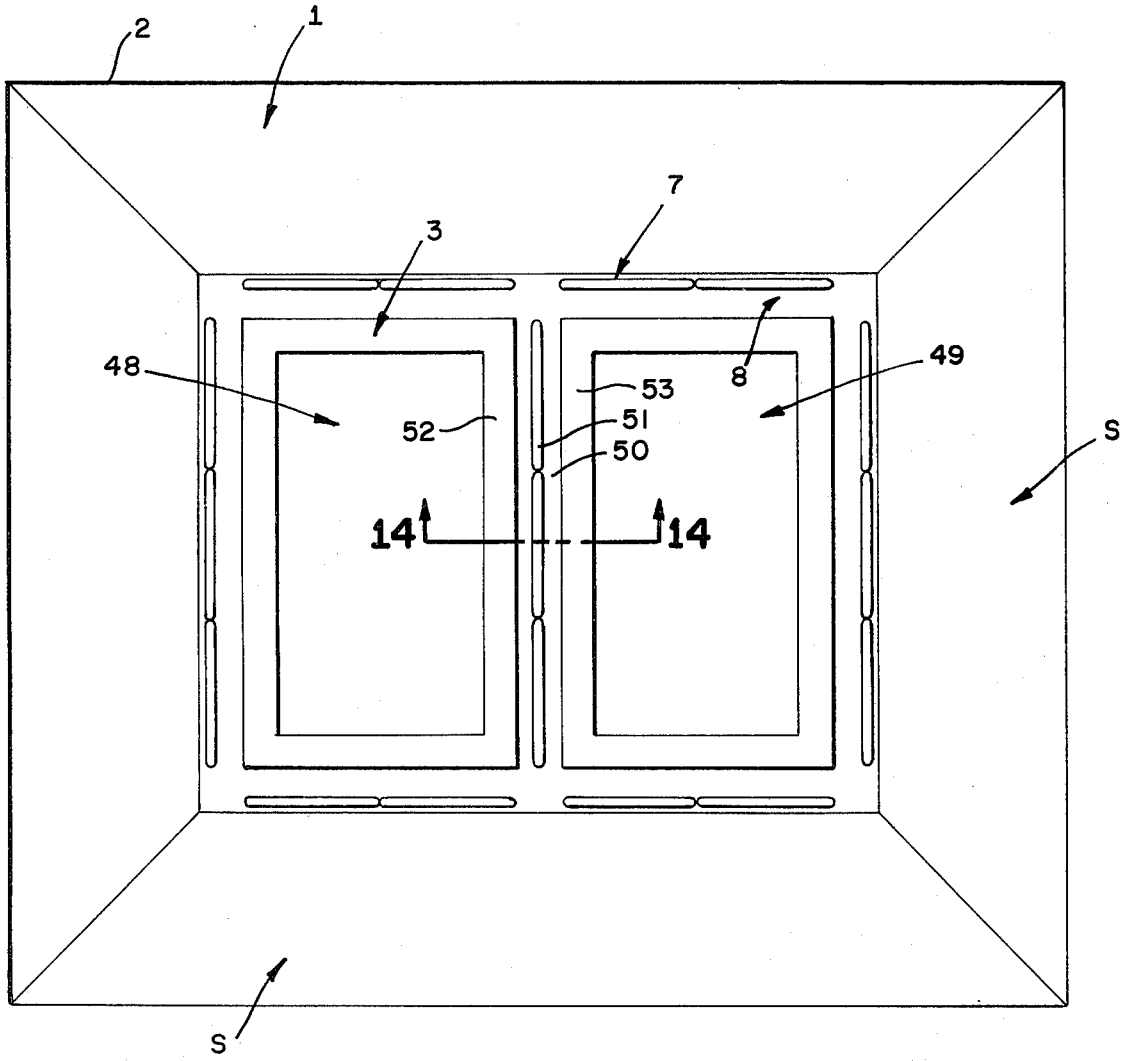
FIG. 9 is a plan view of a slope sided reservoir showing a cover formed with a plurality of sections making up the main central portion and using the present invention.

FIG. 9 illustrates a modified cover in which the central portion is divided into two segments 48 and 49 separated by an intermediate sump 50. The intermediate sump is formed by intermediate weight means 51 affixed to the cover in the intermediate sump. Any of the previously described weight means may be used to create the sump. The weight means should be attached so that the intermediate sump intersects the peripheral sump. FIG. 14 illustrates the manner in which the intermediate sump is formed and the sections are drained. The water flows through pipes 15 and 16 beneath intermediate floats 52 and 53.

Figure 10:
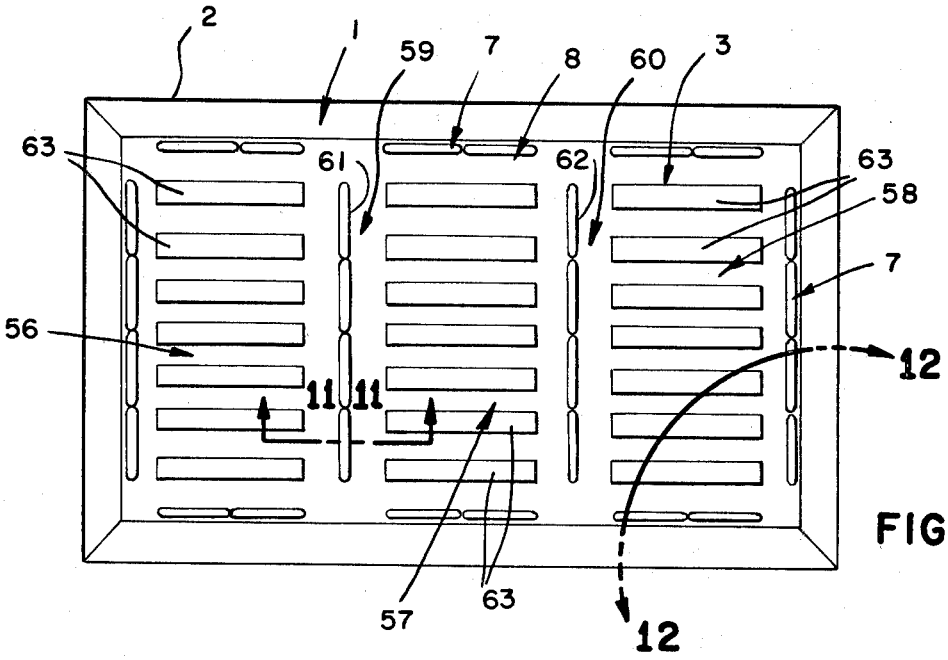
FIG. 10 is a plan view of a reservoir on a greatly reduced scale showing a cover with a plurality of sections making up the central portion and illustrating a different type of float configuration.
Figure 11:
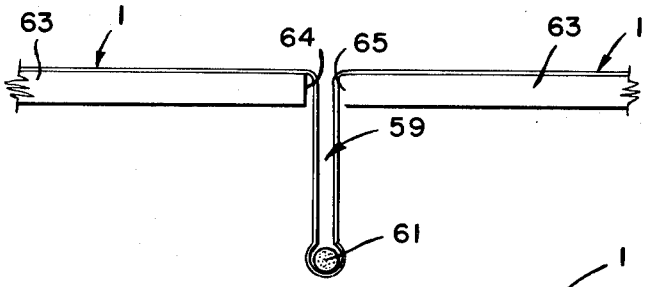
FIG. 11 is an enlarged fragmentary cross section taken along line 11—11 of FIG. 10.

FIG. 10 illustrates still another configuration of the float means in which a plurality of segments 56, 57 and 58 make up the central portion of the cover. Two intermediate sumps 59 and 60 are formed by intermediate weight means 61 and 62. The weight means may be constructed by any of the means previously described but preferably the weight means is attached closely to the cover midway between the ends of the floats. In this form of the invention, there is no solid perimeter float means but rather a plurality of linear float members 63 attached to the cover segments 56–58. The linear floats are axially aligned in pairs across the intermediate sumps so that as shown in FIG. 11, when the conditions cause the intermediate sumps to be very narrow at the surface, the ends 64 and 65 of the paired floats will approach and may even touch one another. This placement of the floats minimizes the distortion and stress which would otherwise result in the cover.

FIG. 12 illustrates the placement of the weights in relation to the floats at the corners of the central floating portion. The same arrangement is also pertainable to the intersection of the intermediate sumps with the peripheral sump. Specifically, the ends 66 and 67 of the weights should not intrude into a non-interference area 68 which is formed by the projection lines indicated by the numbers 69 and 70 which extend beyond the perimeter lines 71 and 72 of the central float area. By placing the weights in this manner the ends of the weights will not bump into each other and set up stresses in the flexible cover.

I claim:

1. A flexible cover for a reservoir comprising:

a. said cover is substantially a fluid impervious sheet and is attached to the periphery of said reservoir and has an area dimensioned to cover the walls and bottom of said reservoir when empty;

b. said cover includes a central portion covering a substantial portion of said reservoir surface;

c. float means buoyantly carrying at least portions of substantially the entire border area of said central portion of said cover;

d. weight means affixed to said cover outwardly of said border area of said central portion and outwardly of said float means around substantially said entire central portion so as to place substantially all of said central portion inwardly of said border area in tension in at least two different horizontal directions of sufficient magnitude to permit workmen to traverse all portions of said central portion of said horizontal cover for all working levels with said central horizontal portion remaining substantially planar in sustaining the weight of the workmen at all working levels of said reservoir;

e. said weight means and said float means are positioned so as to initiate and form a defined peripheral sump outwardly and immediately adjacent said entire border area of said central portion to receive surface water from said central portion; and f. said peripheral sump having inner and outer sidewalls on which at least the upper portion of said inner sidewall between said float means and said weight means is in tension.

2. A flexible cover as described in claim 1 for a reservoir comprising:

a. said central portion of said cover is substantially the same size and configuration as said generally horizontal bottom surface of said reservoir.

3. A flexible cover as described in claim 1 for a substantially vertically sided reservoir comprising:

a. said weight means is formed with attachment means which are attached to said portions of said cover which lie in substantial surface contact with said vertical walls when said reservoir is empty;

b. said weight means is positioned on said bottom portion of said cover when said reservoir is substantially empty; and c. connection means connecting said weight means to said attachment means.

4. A flexible cover as described in claim 1 for a substantially vertically sided reservoir comprising:

a. said weight means is formed with attachment means which are attached to said vertical wall portions of said cover at a distance of at least ¼ the reservoir full level from said reservoir bottom, when said reservoir is substantially empty;

b. said weight means is positioned on said bottom portion of said cover when said reservoir is empty;

c. connection means connecting said weight means to said attachment means; and d. said inner and outer sidewalls of said peripheral sump are both tensioned by said weight means.

5. A flexible cover as described in claim 1 for a slope sided reservoir comprising:

a. said weight means are connected to said portions of said cover which lie in substantial surface contact with said bottom of said reservoir when it is empty;

b. said inner and outer sidewalls of said peripheral sumps are tensioned by said weight means; and c. said cover is formed with horizontal portions between said periphery of said reservoir and said central portion which are tensioned by said weight means.

6. A flexible cover as described in claim 5 wherein:

a. the distance from the toe of the slope to the edge of said central cover portion when said reservoir is empty is equal to or greater than ½ of the difference between the top water level of the slope sided wall to the toe of slope and the horizontal distance from the peripheral edge of the reservoir and a projection from the toe of the sloped wall to the top maximum water surface.

7. A flexible cover as described in claim 1 for a slope sided reservoir comprising:

a. said weight means is formed with attachment means which are attached to said portions of said cover which lie in substantial surface contact with said slope side walls;

b. said weight means is positioned on said bottom portion of said cover when said reservoir is empty; and c. connecting means connecting said weight means to said attachment means.

8. A flexible cover as described in claim 1 for a slope sided reservoir comprising:

a. said weight means is formed with attachment means which are attached to said portions of said cover which lie in substantial surface contact with said slope sided wall at a distance of at least ¼th the reservoir full level from the bottom when said reservoir is empty;

b. weight means positioned on said bottom portions of said cover when said reservoir is empty;

c. connecting means connecting said weight means to said attachment means;

d. said inner and outer sidewalls of said peripheral sump are tensioned by said weight means; and e. said horizontal portion of said cover between said periphery of said reservoir and said central portion is tensioned by said weight means.

9. A flexible impermeable cover for a reservoir as described in claim 1 comprising:

a. said central portion is divided into a plurality of segments, each formed with an intermediate sump therebetween;

b. intermediate float means buoyantly carrying at least portions of the border of said segments; and c. intermediate weight means affixed to said cover in said intermediate sump area causing said walls of said intermediate sump and said adjacent cover segments to be in tension and located so that said intermediate sump intersects with said peripheral sump.

10. A cover as described in claim 9 wherein:

a. said intermediate float members intersect said peripheral and intermediate sumps at an angle and also terminate along a line forming a defined peripheral central floating portion; and b. said intermediate float members are paired so as to engage one another when said intermediate sumps are empty to prevent excessive downward movement of said intermediate weight means.

* * * * *